US007555793B2

(12) United States Patent
Howitt

(10) Patent No.: US 7,555,793 B2
(45) Date of Patent: Jul. 7, 2009

(54) EMERGENCY EVACUATION APPARATUS FOR A BED-RIDDEN PERSON

(75) Inventor: Kevin Howitt, Leicester Forest East (GB)

(73) Assignee: Rescue-Bed Limited, Leiscester (GB)

( * ) Notice: Subject to any disclaimer, the term of this patent is extended or adjusted under 35 U.S.C. 154(b) by 169 days.

(21) Appl. No.: 10/590,616

(22) PCT Filed: Jan. 17, 2005

(86) PCT No.: PCT/GB2005/000142

§ 371 (c)(1),
(2), (4) Date: May 8, 2007

(87) PCT Pub. No.: WO2005/082308

PCT Pub. Date: Sep. 9, 2005

(65) Prior Publication Data

US 2008/0115283 A1 May 22, 2008

(30) Foreign Application Priority Data

Feb. 24, 2004 (GB) ..... 0403968.1

(51) Int. Cl.
*A47B 1/00* (2006.01)
*A47B 7/02* (2006.01)
*A61G 5/00* (2006.01)

(52) U.S. Cl. ..... 5/626; 5/81.1 R; 5/628; 5/613

(58) Field of Classification Search ..... 5/81, 5/81.1 T, 81.1 R, 613, 626, 627, 625, 83.1, 5/84.1, 81.1 HS, 722, 420, 417
See application file for complete search history.

(56) References Cited

U.S. PATENT DOCUMENTS

| | | | | |
|---|---|---|---|---|
| 3,967,328 | A | 7/1976 | Cox et al. | |
| 4,584,729 | A * | 4/1986 | Roberts et al. | 5/625 |
| 4,686,719 | A * | 8/1987 | Johnson et al. | 5/81.1 R |
| 5,150,487 | A * | 9/1992 | Hemphill | 5/625 |
| 6,061,853 | A * | 5/2000 | Laaksonen et al. | 5/625 |
| 2005/0172406 | A1 * | 8/2005 | Post | 5/626 |

FOREIGN PATENT DOCUMENTS

| | | | |
|---|---|---|---|
| AU | 667183 | B3 | 3/1996 |
| GB | 2157558 | A | 10/1985 |
| GB | 2182570 | A | 5/1987 |
| GB | 2324738 | A | 11/1998 |
| GB | 2387321 | A | 10/2003 |
| WO | WO 00/62731 | A | 10/2000 |

* cited by examiner

*Primary Examiner*—Peter M Cuomo
*Assistant Examiner*—Brittany M Wilson
(74) *Attorney, Agent, or Firm*—Cherskov & Flaynik

(57) ABSTRACT

The invention provides an emergency evacuation apparatus for removing a bed-ridden person from a bed in an emergency situation. The apparatus includes a base tray having at least one transverse fold line to allow the base tray to bend as two or more panels. This apparatus is therefore suitable for use with a modern adjustable bed, which can be electrically or manually operated to adjust the profile of the mattress to provide better ergonomic support for the person lying on the bed. The base tray also has mechanical locking means operable between an unlocked condition where the base tray can bend along the transverse fold line and a locked condition where the base tray is unable to bend along the transverse fold line. The mechanical locking means also provides the base tray with sufficient longitudinal rigidity to support the weight of an adult person.

18 Claims, 5 Drawing Sheets

EMERGENCY EVACUATION APPARATUS FOR A BED-RIDDEN PERSON

CLAIM FOR FOREIGN PRIORITY

The present application claims foreign priority benefits of International Application No. PCT/GB2005/000142 filed 17 Jan. 2005 which in turn claims priority from GB Application 0403968.1 filed 24 Feb. 2004, each of which is incorporated herein by reference in its entirety.

BACKGROUND OF THE INVENTION

1. Field of the Invention

The invention relates to an improved evacuation apparatus to enable the rapid and safe removal of bedridden people from hospitals, old persons homes and other buildings in emergency situations.

2. Background of the Invention

In the event of an emergency requiring the fastest possible evacuation, it is a major concern that the most vulnerable people present the greatest difficulty in being evacuated to safety. The old and infirm, and bed-ridden hospital patients, being persons with limited mobility, are dependent upon helpers to execute their safe evacuation.

British Patent Application 2324738 describes an apparatus that can be used to evacuate a bed-ridden person from a bed in an emergency situation. The apparatus comprises a rigid tray of a length substantially equal to that of the mattress on which the person to be evacuated is lying. Wheels, glide members, roller balls or castors are mounted on the base tray to facilitate its movement over the floor and straps are secured to the tray for wrapping around the mattress to thereby restrain and cocoon the person. Lifting handles may be provided so that the person can be lifted down from the bed and placed on the floor or evacuated out of the building.

Australian Patent 667183 describes a disposable stretcher fabricated from a folded board material that provides a substantially flat base on which a person can lie. The base has a single transverse fold line to enable it to be folded for storage purposes. Two longitudinal fold lines allow edge parts of the base to be folded upwardly to form walls that provide longitudinal reinforcement to the base. A number of hand holes are provided around the periphery of the base and can receive straps to secure the person to the stretcher.

Many hospitals and care homes for the old and infirm are gradually replacing traditional beds of fixed construction with modern adjustable beds. These can be electrically or manually operated to adjust the profile of the mattress to provide better ergonomic support for the person lying on the bed. A conventional adjustable bed has four panels positioned underneath the mattress that can bend relative to each other. The two panels closest to the foot of the bed support the legs of the person and can bend to form a knee-break. The panel closest to the head of the bed can be raised or lowered to help the person to sit up and provides a backrest. The remaining panel does not normally move and supports the hips and waist of the person.

The apparatus described in British Patent Application 2324738 can only be used with traditional beds of fixed construction. There is therefore a need for an emergency evacuation apparatus that is suitable for use with a modern adjustable bed.

SUMMARY OF THE INVENTION

The invention provides an emergency evacuation apparatus for use with an adjustable bed and for removing a bed-ridden person from the adjustable bed in an emergency situation, comprising a base tray having three transverse fold lines to allow the base tray to bend as four panels defining a backrest, an intermediate panel and a knee-break, the base tray being adapted to stay on top of the adjustable bed and bend along the transverse fold lines when the profile of the adjustable bed is changed during normal use; and mechanical locking means operable between an unlocked condition in which the base tray is able to bend along the transverse fold lines and a locked condition in which the base tray is unable to bend along the transverse fold lines and to provide the base tray with sufficient longitudinal rigidity to support the weight of an adult person.

In normal use, the base tray is placed between the panels of an adjustable bed and the mattress. The base tray will bend in register with the associated underlying panels of the adjustable bed but does not hinder the operation of the bed in any way. Preferably, the base tray has substantially the same width as the bed from which the person is to be evacuated.

It is normally preferred that the mechanical locking means are operable in an emergency situation to lock the panels of the base tray in a co-planar configuration so that the bed-ridden person can be removed in a prone position. However, it is also possible that the mechanical locking means are operable to lock the panels of the base tray at any predetermined angle to each other. For example, the three panels closest to the foot end of the emergency evacuation apparatus can be locked in a co-planar configuration but the fourth panel at the head end can be locked at a slight angle with respect to the plane of the remainder of the base tray to provide additional support by raising the person's back.

It will be readily appreciated that the mechanical locking means must be strong enough to provide the base tray with sufficient longitudinal rigidity to allow the emergency evacuation apparatus to support the weight of an adult person.

The mechanical locking means can be of any suitable construction or type. For example, a rigid locking bolt can be made to slide across a transverse fold line when the panels are co-planar. The locking bolt is preferably secured to the underside of one of the panels and can be received in an associated locking aperture provided on the underside of the other panel to prevent the base tray from bending along the transverse fold line. The locking bolt can also be slidably received in a pair of channels or sleeves on the underside of the base tray that extend on both sides of the transverse fold line.

A plurality of mechanical locking means can be provided for each transverse fold line. The mechanical locking means can be operated independently of each other or together in a single locking action Separate mechanical locking means can be provided for each transverse fold line so that respective pairs of panels can be selectively locked together. Alternatively, a single mechanical locking means is provided. For example, a locking bolt can be slidably received in channels or sleeves on the underside of the base tray that extend on both sides of each transverse fold line. The locking bolt has a number of pivot regions that are aligned with the transverse fold lines when the locking bolt is in the unlocked condition. In an emergency situation, the locking bolt can be made to slide when the panels are co-planar so that the pivot regions are no longer aligned with the transverse fold lines and rigid parts of the locking bolt next to the pivot regions extend across the transverse fold lines. If the pivot regions only allow the locking bolt to bend in one plane then the panels can be locking in position by rotating the locking bolt through 90°, for example.

To facilitate its movement over the floor, the underside of the base tray is preferably provided with wheels, glide members, roller balls or castors. These can be fitted in channels provided on the underside of the base tray.

A number of u-shaped runners can be fixed to the underside of the base tray to improve the strength and rigidity of the two or more panels. The runners preferably extend longitudinally to define a pair of parallel channels into which the wheels, glide members, roller balls or castors can be fitted. The runners do not extend across the transverse fold lines and their ends can be cut away or profiled so that they do not prevent the panels of the base tray from bending relative to each other. Strips of high-density foam can be fixed to the underside of the base tray along its edges and between the runners to help support the base tray on top of the panels of the adjustable bed.

The wheels, glide members, roller balls or casters can be retractable so that they only project beyond the underside of the base tray or the channels when they are needed in an emergency situation. Alternatively, the wheels, glide members, roller balls or castors can be received in recesses or channels provided in the top surface of the panels of the adjustable bed.

The base tray can further include a pair of longitudinal fold lines to allow the sides of the base tray to be inclined slightly. The applicant has found that this does not significantly increase the longitudinal rigidity of the emergency evacuation apparatus but does prevent the sides of the base tray from impeding its movement along the floor. The longitudinal fold lines define a central panel for supporting the person and two side panels.

Straps can be secured to the base tray for wrapping around the person in an emergency situation. The straps are preferably provided with snap-fit couplings which permit them to be connected together to encircle the mattress and person prior to tightening them to draw the mattress around the person. Mechanical tensioning means may be provided.

Many adjustable beds have inbuilt hydraulic raising and lowering devices, and a removable tail-board or frame. To evacuate a person in an emergency situation, first of all the adjustable bed is electrically or manually operated so that the panels of the base tray lie in the same plane or at a predetermined angle to each other. The straps are then tightened around the person to secure the person on the base tray. If the panels are co-planar then this tightening of the straps also causes the base tray to bend slightly along the longitudinal fold lines. The mechanical locking means are operated from the unlocked condition to the locked condition to maintain the panels in the desired configuration (normally co-planar) and provide the base tray with sufficient longitudinal rigidity to support the weight of an adult person. It will be appreciated that operating the mechanical locking means immediately forms an extremely robust and rigid structure that is capable of being used as a stretcher to evacuate the person to safety.

After tightening the straps around the mattress and person to cocoon and restrain the person, the adjustable bed is lowered to its minimum height, the tail-board or frame removed and the rigid base tray pulled down the bed to an intermediate position in which it tips with its foot end resting on the floor and its head end resting on the foot end of the bed. The base tray can then be gently lowered on to the floor.

If the tail-board or frame of the adjustable bed is not removable then it can include rollers or fixed projections for engagement with the runners fixed to the underside of the base tray. In this case, the foot end of the rigid base tray is raised and then pulled over the tail-board or frame with the rollers or fixed projections engaging with the runners to act as guides and prevent the base tray deviating from side to side. The base tray is placed in an intermediate position in which it tips with its foot end resting on the floor and its head end resting on the tail-board or frame. The head end can then be gently lowered to the floor.

The base tray can be made of polypropylene so that it is strong and lightweight. If u-shaped runners are provided then these can be made of aluminium and riveted to the underside of the base tray.

The base tray is preferably formed in a single piece with the transverse and longitudinal fold lines being hydraulically pressed into the base tray.

To facilitate the subsequent evacuation of the person, carrying handles can be secured to the sides of the base tray. A handle can also be secured to one end of the base tray to assist in raising the base tray or pulling it down the bed to the intermediate position.

One embodiment of the present invention relates to an emergency evacuation apparatus for use with an adjustable bed and adapted to remove a bed-ridden person from the adjustable bed in an emergency situation. The apparatus comprises a base tray (made of polypropylene for example) and mechanical locking means (one or more rigid locking bolts for example) and has three transverse fold lines allowing the base tray to bend as four panels defining a backrest, an intermediate panel and a knee-break. The base tray is adapted to stay on top of the adjustable bed and bend along the transverse fold lines when the profile of the adjustable bed is changed during normal use. The mechanical locking means is operable between an unlocked condition, in which the base tray is able to bend along the transverse fold lines, and a locked condition, in which the base tray is unable to bend along the transverse fold lines, providing the base tray with sufficient longitudinal rigidity to support the weight of an adult person.

Another embodiment relates to a combination of an adjustable bed having a plurality of panels that can bend relative to each other and an emergency evacuation apparatus for removing a bed-ridden person from the adjustable bed in an emergency situation. The emergency evacuation apparatus comprises a base tray and mechanical locking means. The base tray has a plurality of transverse fold lines allowing the base tray to bend as a plurality of panels. The mechanical locking means is operable between an unlocked condition, in which the base tray is able to bend along the transverse fold lines in register with the underlying panels of the adjustable bed, and a locked condition, in which the base tray is unable to bend along the transverse fold lines, providing the base tray with sufficient longitudinal rigidity to support the weight of an adult person. The adjustable bed may have a tail board including rollers or fixed projections for engagement with runners fixed to the underside of the base tray assisting in the removal of the emergency of the emergency evacuation apparatus from the adjustable bed.

Yet another embodiment relates to a method of evacuating a bed-ridden person from an adjustable bed having a plurality of panels that can bend relative to each other using an emergency evacuation apparatus. The method comprises the steps of operating the adjustable bed with a mechanical locking means in an unlocked position, and bending panels of a base tray along transverse fold lines in register with underlying panels of the adjustable bed until the panels of the base tray lie in the same plane or at a predetermined angle to each other. A mechanical locking means is operated from an unlocked condition to a locked condition so that the base tray is unable to bend along the transverse fold lines providing the base tray with sufficient longitudinal rigidity to support the weight of an adult person.

In at least one embodiment, an underside of the base tray of the emergency evacuation apparatus is provided with wheels, glide members, roller balls or castors to facilitate its movement over the floor, where the wheels, glide members, roller balls or castors are fitted in channels on the underside of the base tray. Additionally, u-shaped runners may be fixed to the underside of the base tray into which the wheels, glide members, roller balls or castors are fitted. The base tray may include straps secured thereto for wrapping around the person in an emergency situation to restrain the person. The straps may be provided with snap-fit couplings which permit the straps to be connected together to encircle the person prior to tightening the straps.

Still other embodiments may comprise the base tray having two longitudinal folds lines defining a central panel supporting the person, and two side panels that can be bent out of the plane of the central panel by the straps. The transverse and longitudinal fold lines may be hydraulically pressed into the base tray.

In yet other embodiments, the emergency evacuation apparatus may include carrying handles secured to the sides of the base tray and least one (one or more) strip of foam fixed to an underside of the base tray. The base tray and the adjustable bed may have the same number of panels and be substantially the same width as the adjustable bed.

DETAILED DESCRIPTION OF THE INVENTION

Figure 1:
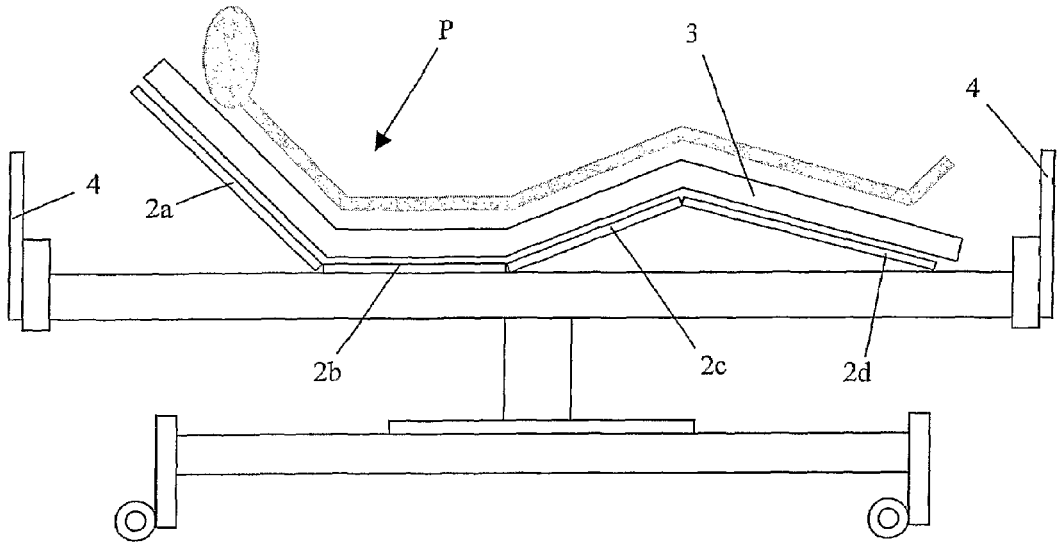
FIG. 1 is a side view of an adjustable bed.
Figure 2:
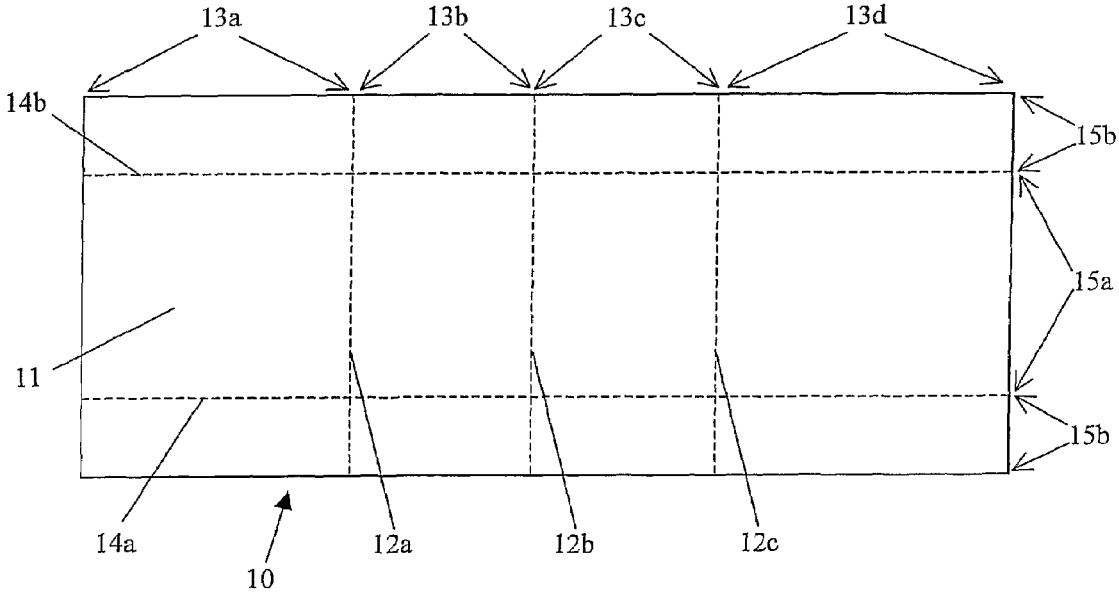
FIG. 2 is a top view of an emergency evacuation apparatus in accordance with the present invention.

FIG. 1 shows an adjustable bed having four panels 2 supporting a mattress 3. The foot end and head end of the bed are provided with fixed tail-boards 4 to prevent the mattress 3 from sliding off the panels 2. The panels can be electrically or manually operated to adjust the profile of the mattress 3 to support the person P in a number of different ways. The panel 2*a* closest to the head end of the bed acts as a backrest and can be raised or lowered to help the person P sit up or lie down. The intermediate panel 2*b* does not move and supports the hips and waist of the person P. The two panels 2*c* and 2*d* closest to the foot end of the bed can bend together to form a knee-break.

With reference to FIGS. 2 to 6, an emergency evacuation apparatus 10 has a base tray 11 formed from a single sheet of polypropylene. Three transverse fold lines 12*a*, 12*b* and 12*c* are hydraulically pressed into the polypropylene sheet to divide the base tray 11 into four panels 13*a* to 13*d*. The base tray 11 has substantially the same width as the panels 2 of the adjustable bed. Moreover, the transverse fold lines 12 are positioned so that the four panels 13 of the base tray 11 are substantially the same size as the associated panels 2 of the adjustable bed.

Two longitudinal fold lines 14*a* and 14*b* are hydraulically pressed into the polypropylene sheet to divide the base tray 11 into a central panel 15*a* and two side panels 15*b*.

Figure 4:
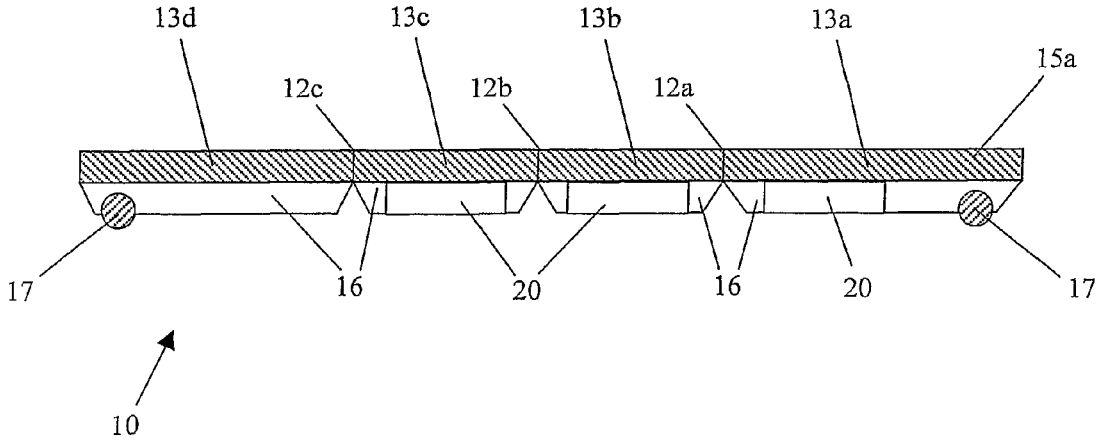
FIG. 4 is a cross-section view taken along line AA shown in FIG. 3 with the locking bolts in an unlocked condition.
Figure 5:
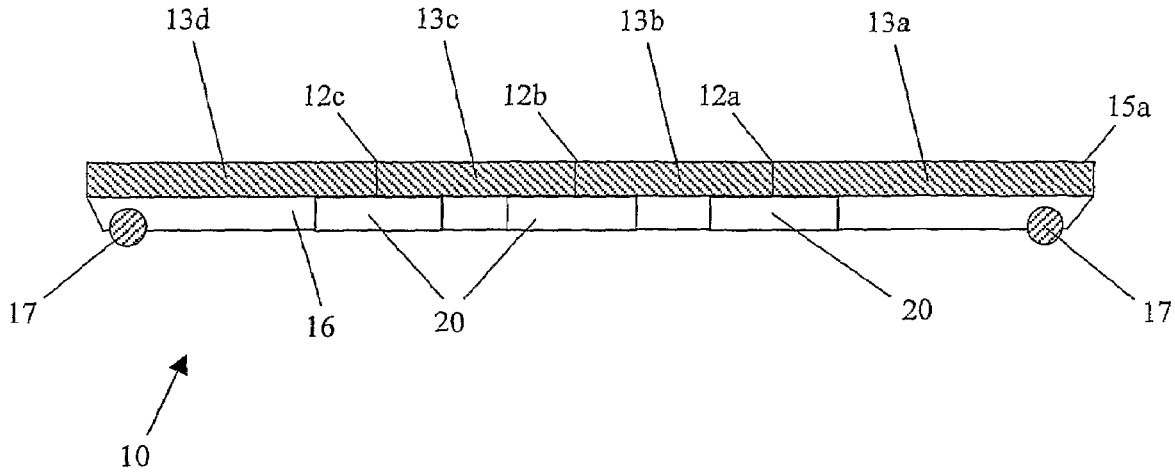
FIG. 5 is a cross-section view taken along line AA shown in FIG. 3 with the locking bolts in a locked condition.
Figure 6:
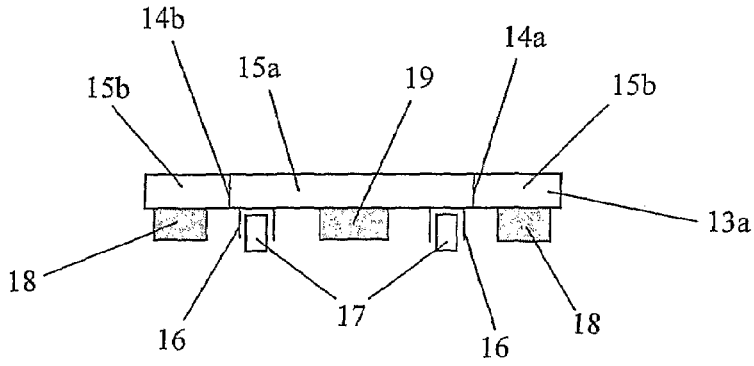
FIG. 6 is an end view of the apparatus of FIG. 2.

A number of u-shaped aluminium runners 16 are riveted to the underside of the central panel 15*a* of the base tray 11 to define a pair of parallel channels. As best shown in FIG. 4, the runners 16 do not extend across the transverse fold lines 12 and their facing ends are cut away or profiled so that they do not prevent the panels 13 bending relative to each other. A pair of wheels 17 is provided in the channels at each end of the base tray.

Two strips 18 of high-density foam having substantially the same depth as the runners 16 are attached to the underside of the side panels 15*b* of the base tray 11 and help support the base tray on top of the panels 2 of the adjustable bed. The strips of high-density foam can be replaced by u-shaped aluminium runners to provide additional strength and rigidity to the side panels 15*b*. A further strip 19 of high-density foam is attached to the underside of the central panel 15*a* of the base tray 11. The strips 18 and 19 of high-density foam are cut into sections so that they do not extend across the transverse fold lines 12.

In normal use, the part of each wheel 17 that projects outside the associated runner 16 is received in a recess (not shown) provided in the top surface of the panels 2*a* and 2*d* of the adjustable bed.

Figure 3:
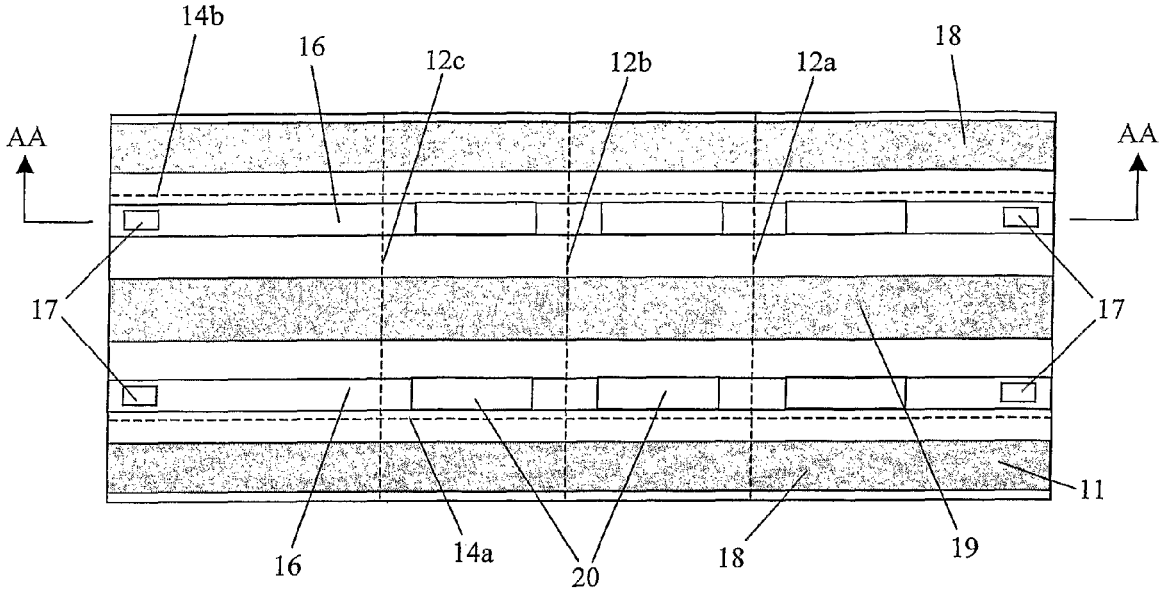
FIG. 3 is a bottom view of the apparatus of FIG. 2 with the locking bolts in an unlocked condition.

Six rigid locking bolts 20 are received in the u-shaped runners 16 and retained by inwardly extending lips (not shown). In FIGS. 3 and 4 the locking bolts 20 are in an unlocked condition and do not extend across the transverse fold lines 12*a*, 12*b* and 12*c* so the panels 13*a* to 13*d* of the base tray 11 are free to bend relative to each other.

In an emergency situation, the locking bolts 20 are moved to a locked condition by sliding them along the u-shaped runners 16 until they extend across the transverse fold lines 12*a*, 12*b* and 12*c*. This action locks the panels 13*a* to 13*d* together so that the base tray 11 is made sufficiently rigid in the longitudinal direction to support the weight of an adult person.

Figure 7:
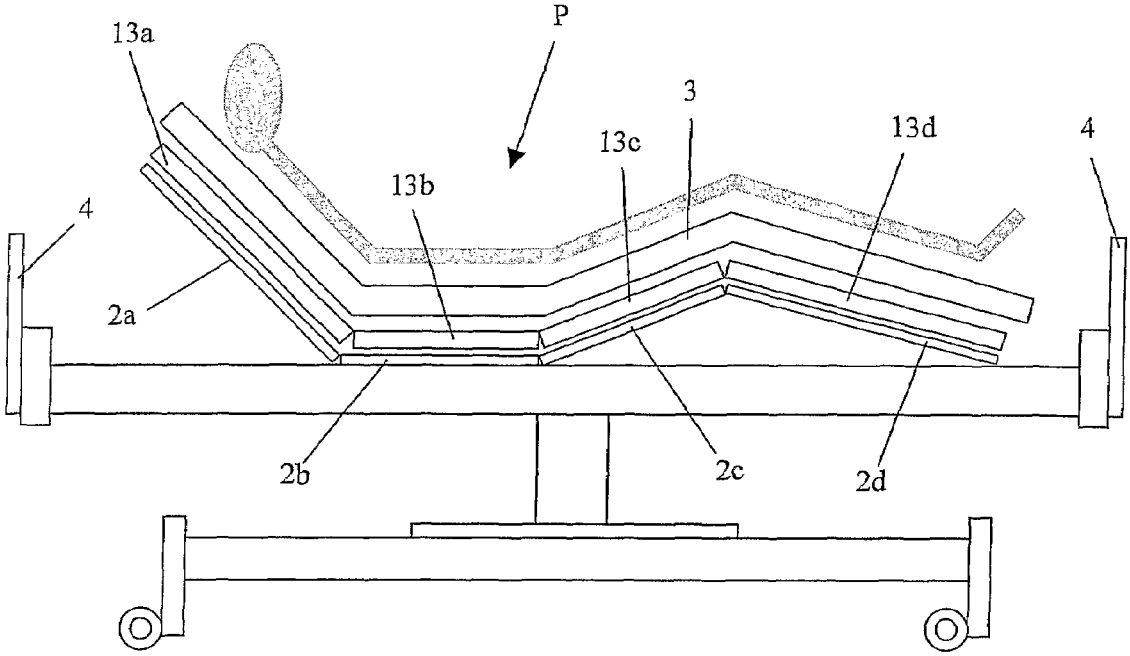
FIG. 7 is a side view showing the apparatus of FIG. 2 placed on an adjustable bed.

FIG. 7 shows how the base tray 11 is positioned on the adjustable bed such that the panels 13*a* to 13*d* are in register with the associated panels 2*a* to 2*d*. (It will be readily appreciated that the wheels 17 and the strips 18 of high-density foam have been omitted from FIG. 6 to improve the clarity of the drawing.)

Figure 8:
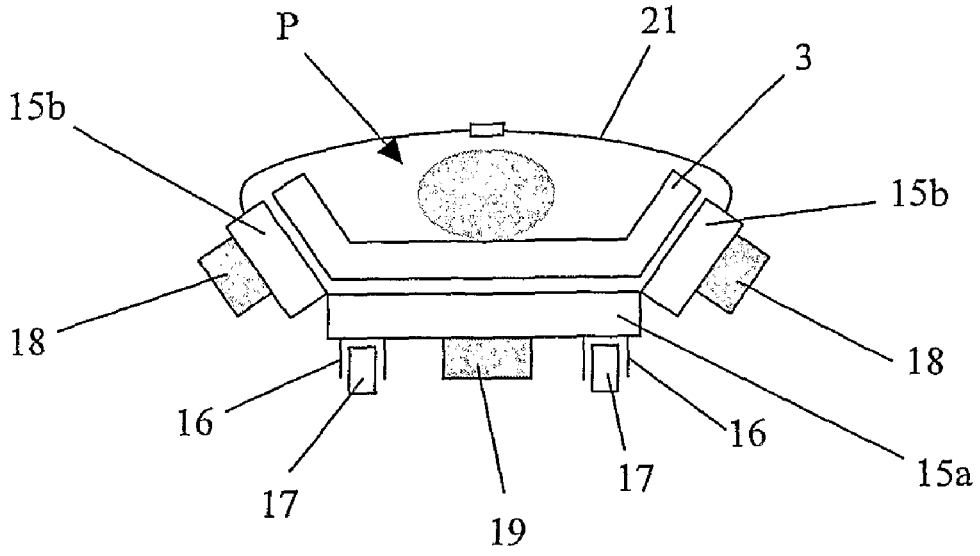
FIG. 8 is an end view showing the apparatus of FIG. 2 being used to restrain a person.
Figure 9:
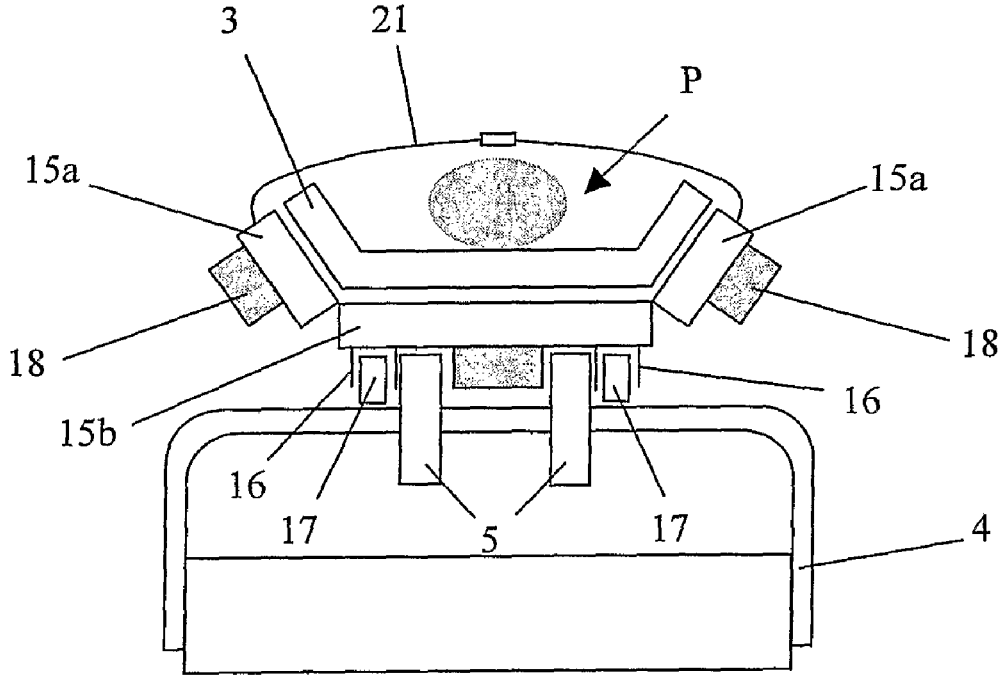
FIG. 9 is an end view showing the apparatus of FIG. 2 being raised over the tail-board of an adjustable bed.

With reference to FIGS. 8 and 9, in an emergency situation, the adjustable bed is operated so that the panels 2 are lowered until they are horizontal and the panels 13 of the base tray 11 lie in the same plane. Straps 21 secured to the side of the base tray (not shown in FIGS. 2 to 6 to improve the clarity of those drawings) are tightened around the person P to bend the base tray 11 along the longitudinal fold lines 14*a* and 14*b* and wrap the mattress 3 around the person to form a shielding cocoon of mattress material. (In practice, the applicant has found that the base tray 11 does not bend very much along the longitudinal fold lines 14*a* and 14*b* because of the thickness of the mattress. The angle of the side panels 15*b* relative to the central panel 15*a* has been exaggerated to improve the clarity of the drawings.) Finally, the locking bolts 20 are operated from the unlocked condition to the locked condition as described above.

The adjustable bed is lowered to its minimum height and the rigid base tray 11 is raised and pulled over the fixed tail-board 4 at the foot end of the bed. The tail-board 4 is provided with a pair of rollers 5 which engage with the runners 16 to act as guides to prevent the base tray 11 deviating from side to side. The base tray 11 is placed in an intermediate position in which it tips with its foot end resting on the floor and its head end resting on the tail-board 4. The head end is gently lowered to the floor and the base tray 11.

The base tray 11 can be moved over the floor using the wheels 17. Carrying handles (not shown) secured to the sides of the base tray 11 can also be used to carry the base tray if the person has to be evacuated to safety.

The invention claimed is:

1. An emergency evacuation apparatus for use with an adjustable bed and for removing a bed-ridden person from the adjustable bed in an emergency situation, comprising a base tray having three transverse fold lines to allow the base tray to bend as four panels defining a backrest, an intermediate panel and a knee-break, the base tray being placed between the adjustable bed and a mattress supporting the bed-ridden person wherein the base tray is adapted to bend along the transverse fold lines when the profile of the adjustable bed is changed during normal use of the adjustable bed by the bed-ridden person; a mechanical locking means operable between an unlocked condition in which the base tray is able to bend along the transverse fold lines and a locked condition in which the base tray is unable to bend along the transverse fold lines and to provide the base tray with sufficient longitudinal rigidity to support the weight of an adult person thereby allowing the base tray carrying the mattress and the bed-ridden person to be lifted off of the adjustable bed.

2. The emergency evacuation apparatus according to claim 1, wherein the mechanical locking means comprises at least one rigid locking bolt.

3. The emergency evacuation apparatus according to claim 1, wherein an underside of the base tray is provided with wheels, glide members, roller balls or castors to facilitate its movement over the floor.

4. The emergency evacuation apparatus according to claim 3, wherein the wheels, glide members, roller balls or castors are fitted in channels on the underside of the base tray.

5. The emergency evacuation apparatus according to claim 3, further comprising u-shaped runners fixed to the underside of the base tray into which the wheels, glide members, roller balls or castors are fitted.

6. The emergency evacuation apparatus according to claim 5 in combination with the adjustable bed, wherein a tail-board of the adjustable bed includes rollers or fixed projections for engagement with the runners fixed to the underside of the base tray to assist in the removal of the emergency evacuation apparatus from the adjustable bed.

7. The emergency evacuation apparatus according to claim 5, further comprising retractable wheels wherein in a first retracted configuration, no surface of the wheels extends beyond a horizontal plane of the base tray and in a second extended configuration, the surface of the wheels extends beyond the horizontal plane of the base tray.

8. The emergency evacuation apparatus according to claim 1, further comprising straps secured to the base tray for wrapping around the person in an emergency situation to restrain the person.

9. The emergency evacuation apparatus according to claim 8, wherein the straps are provided with snap-fit couplings which permit the straps to be connected together to encircle the person prior to tightening the straps.

10. The emergency evacuation apparatus according to claim 8, wherein the base tray has two longitudinal folds lines defining a central panel for supporting the person and two side panels that can be bent out of the plane of the central panel by the straps.

11. The emergency evacuation apparatus according to claim 10, wherein the transverse and longitudinal fold lines are hydraulically pressed into the base tray.

12. The emergency evacuation apparatus according to claim 1, wherein the base tray is made of polypropylene.

13. The emergency evacuation apparatus according to claim 1, further comprising carrying handles secured to sides of the base tray.

14. The emergency evacuation apparatus according to claim 1, further comprising at least one strip of foam fixed to an underside of the base tray.

15. A combination of an adjustable bed having a plurality of panels that can bend relative to each other and an emergency evacuation apparatus for removing a bed-ridden person from the adjustable bed in an emergency situation, the emergency evacuation apparatus comprising a base tray having a plurality of transverse fold lines to allow the base tray to bend as a plurality of panels, in registration with the same number of the panels of the bed but below a mattress; and mechanical locking means operable between an unlocked condition in which the base tray is able to bend along the transverse fold lines in register with the underlying panels of the adjustable bed and a locked condition in which the base tray is unable to bend along the transverse fold lines and to provide the base tray with sufficient longitudinal rigidity to support the weight of an adult person.

16. The combination of the adjustable bed and the emergency evacuation apparatus according to claim 15, wherein the base tray and the adjustable bed have the same number of panels.

17. The combination of the adjustable bed and the emergency evacuation apparatus according to claim 15, wherein the base tray has substantially the same width as the adjustable bed.

18. A method of using an emergency evacuation apparatus with an adjustable bed having a plurality of panels that can bend relative to each other, comprising the steps of:

locating the emergency evacuation apparatus on top of the adjustable bed;

operating the adjustable bed with a mechanical locking means of the emergency evacuation apparatus in an unlocked position such that panels of a base tray of the emergency evacuation apparatus bend along transverse fold lines in register with underlying panels of the adjustable bed;

when a bed-ridden person is to be evacuated from the adjustable bed, bending the panels of the base tray of the emergency evacuation apparatus along the transverse fold lines in register with the underlying panels of the adjustable bed until the panels of the base tray lie in the same plane or at a predetermined angle to each other; and operating the mechanical locking means from the unlocked position to the locked position so that the base tray is unable to bend along the transverse fold lines, thereby providing the base tray with sufficient longitudinal rigidity to support the weight of an adult person.

* * * * *